US011396843B2

(12) United States Patent
Hrusch et al.

(10) Patent No.: US 11,396,843 B2
(45) Date of Patent: Jul. 26, 2022

(54) CRANKTRAIN PHASE ADJUSTER FOR VARIABLE COMPRESSION RATIO

(71) Applicant: Schaeffler Technologies AG & Co. KG, Herzogenaurach (DE)

(72) Inventors: Nicholas Hrusch, Wooster, OH (US); Todd Sturgin, Wooster, OH (US); Jeffrey Hemphill, Copley, OH (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 17/324,922

(22) Filed: May 19, 2021

(65) Prior Publication Data

US 2021/0363917 A1 Nov. 25, 2021

Related U.S. Application Data

(60) Provisional application No. 63/027,977, filed on May 21, 2020.

(51) Int. Cl.
*F02B 75/04* (2006.01)

(52) U.S. Cl.
CPC ..... *F02B 75/044* (2013.01)

(58) Field of Classification Search
CPC ..... F02B 75/044
See application file for complete search history.

(56) References Cited

U.S. PATENT DOCUMENTS 6,505,582 B2 * 1/2003 Moteki ..... F02B 75/048 123/48 B
2006/0174616 A1 * 8/2006 Yoshida ..... F16D 31/02 60/487
2017/0284291 A1 10/2017 Zahdeh

FOREIGN PATENT DOCUMENTS

JP 2018048648 A * 3/2018 ..... F02B 75/045

* cited by examiner

*Primary Examiner* — Kevin A Lathers
(74) *Attorney, Agent, or Firm* — Volpe Koenig

(57) ABSTRACT

A phase adjuster assembly is disclosed herein that is configured to adjust a phase between a driving component and driven component of an internal combustion engine. The phase adjuster assembly includes an input gear configured to be driven by the driving component and an output gear configured to drive the driven component. A piston plate assembly is configured to adjust a phase between the driving component and the driven component via axial displacement of the piston plate assembly. A hydraulic fluid system is configured to selectively provide hydraulic fluid to a first piston control chamber on a first side of the piston plate assembly and to a second piston control chamber on a second side of the piston plate assembly to axially displace the piston plate assembly such that the phase between the driving component and the driven component is adjusted.

20 Claims, 4 Drawing Sheets

CRANKTRAIN PHASE ADJUSTER FOR VARIABLE COMPRESSION RATIO

INCORPORATION BY REFERENCE

This application claims priority to U.S. Provisional Application No. 63/027,977, which was filed on May 21, 2020, and is incorporated herein by reference in its entirety.

FIELD OF INVENTION

This disclosure is generally related to a cranktrain phase adjuster that can vary a compression ratio of an internal combustion (IC) engine.

BACKGROUND

Variable compression ratio (VCR) adjustment in IC engines is generally used in order to achieve greater efficiency and improved fuel consumption than an engine with a fixed compression ratio. VCR adjustment systems can rely on a variety of structures and configurations to vary the compression ratio.

Known VCR adjustment systems are typically either expensive, complicated to integrate with the engine components or require significant space to be installed.

It would be desirable to provide an affordable and compact phase adjuster assembly for a cranktrain to implement VCR in an IC engine.

SUMMARY

In one aspect, a phase adjuster is disclosed herein that is compact and completely variable. In one aspect, the phase adjuster is configured to adjust a phase between a driving component and driven component of an internal combustion engine. The phase adjuster assembly includes an input gear configured to be driven by the driving component and an output gear configured to drive the driven component.

A piston plate assembly is configured to adjust a phase between the driving component and the driven component via axial displacement of the piston plate assembly, according to one aspect.

A hydraulic fluid system is configured to selectively provide hydraulic fluid to a first piston control chamber on a first side of the piston plate assembly or to a second piston control chamber on a second side of the piston plate assembly to axially displace the piston plate assembly such that a phase between the driving component and the driven component is adjusted.

In one aspect, the output gear is connected to a hub, and the hub defines apply ports and release ports that are selectively fluidly connected to the first piston control chamber and the second piston control chamber.

The phase adjuster assembly can further include a spool valve that is axially displaceable to control fluid flow relative to the apply ports and the release ports. The spool valve can be arranged radially inside of the hub.

A spool spring can be configured to engage the spool valve, and a return spring can be configured to engage the piston plate assembly. The spool spring can be configured to bias the spool valve in a first axial direction, and the return spring biases the piston plate assembly in a second axial direction opposite from the first axial direction. In one aspect, the return spring has a first end engaging the piston plate assembly and a second end engaging a support plate.

A spool piston control chamber can be defined between the spool valve and a valve body housing, in one aspect. The valve body housing can include a control hydraulic line and flow passages that are configured to direct fluid into the spool piston control chamber depending on a relative position of a control valve.

In one aspect, an outer chamber is defined at least partially between an output housing and a valve body housing in an outer direction, and a drive plate and a support plate in an inner direction. The outer chamber can be configured to receive fluid via a restricted flowpath from the spool piston control chamber. The support plate can include a first end supported on a bushing mounted on the hub, and a second end of the support plate can be connected to the input gear.

In one aspect, the input gear is connected to a support plate and a drive plate, and the drive plate defines roller pockets for a roller-ramp assembly. The drive plate can define an interior boundary for an outer fluid chamber, and the drive plate can define an exterior boundary for at least one piston control chamber.

The driving component is a crankshaft and the driven component is an eccentric shaft, in one aspect. Other engine configurations can use the embodiments disclosed herein.

A method for adjusting a phase between a driving component and a driven component is also disclosed herein.

Additional embodiments described below and in the claims.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION

Figure 1:
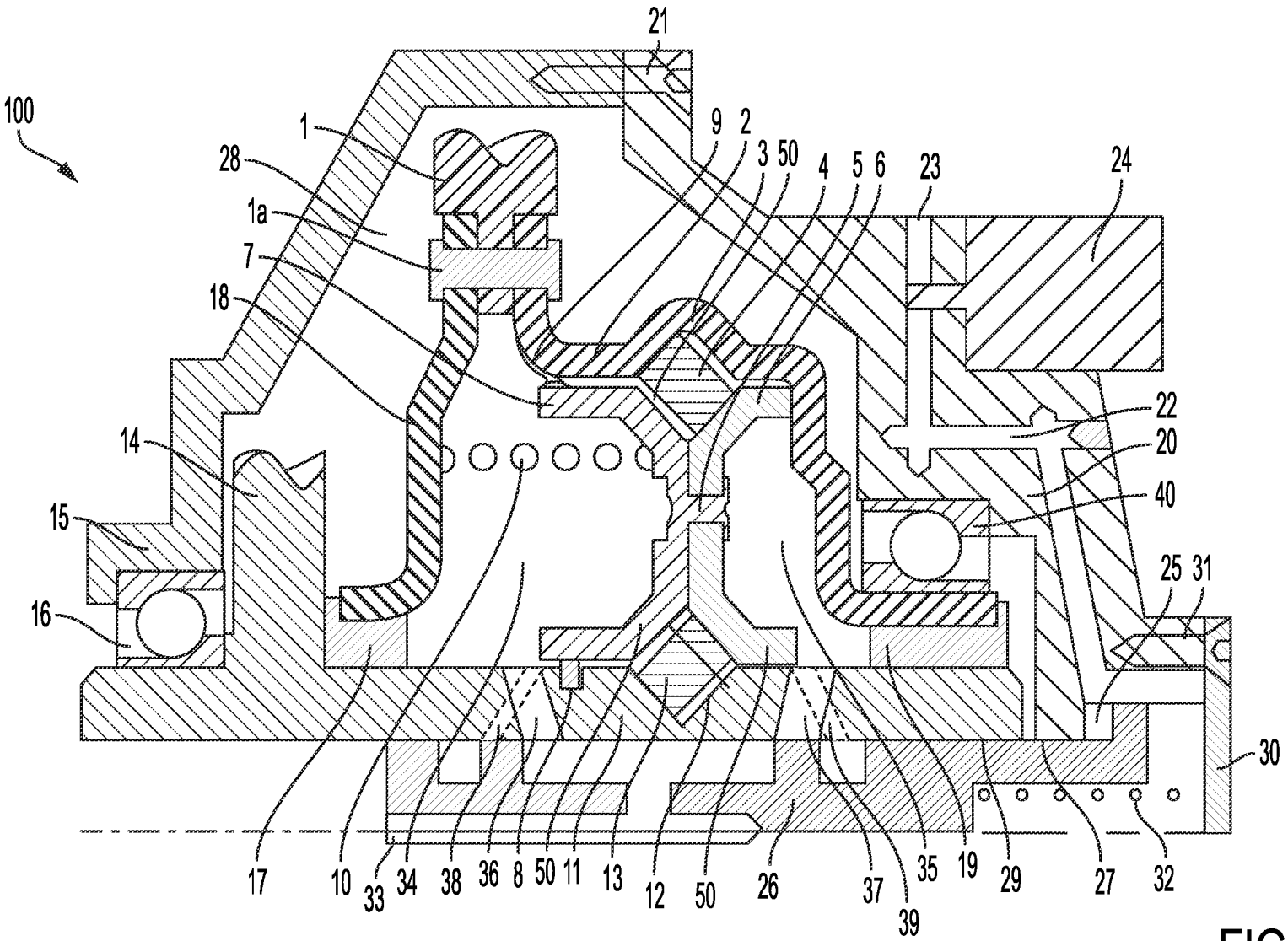
FIG. 1 is a cross-sectional view of a phase adjuster according to one aspect.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. This terminology includes the words specifically noted above, derivatives thereof and words of similar import. "Generally," or "approximately" refers to +/−10% of the indicated value.

Figure 4:
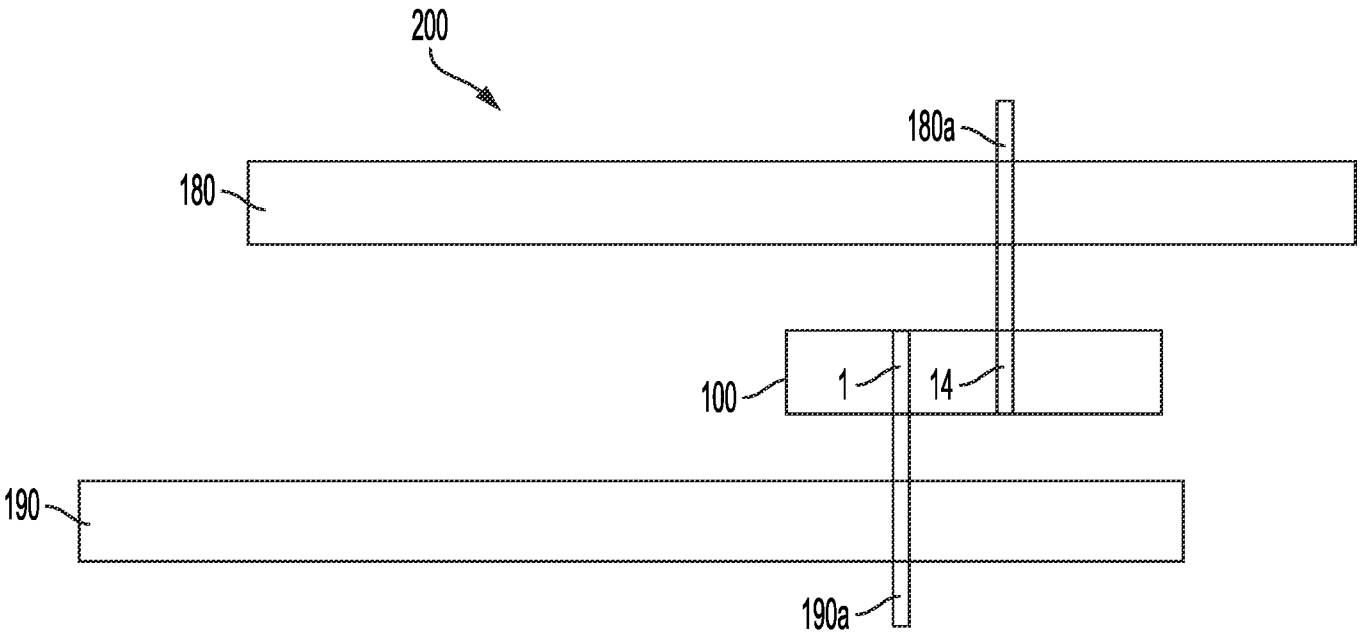
FIG. 4 is a schematic view of a phase adjuster according to one aspect.

FIG. 4 illustrates a schematic diagram showing the arrangement of a cranktrain 200. As used herein, the term cranktrain 200 can refer to an arrangement that generally includes a piston, a crankshaft 190, and an eccentric shaft 180. A phase adjuster 100, in one aspect, is configured to adjust phasing between the crankshaft 190 and the eccentric shaft 180, which varies the compression ratio. In general, the phase adjuster 100 is configured to continuously adjust between a high compression ratio (i.e. high efficiency, lower load) and low compression ratio (i.e. low efficiency, high load), depending on the driving conditions. One goal of a phase adjuster is to maintain the most efficient engine operating point in any driving condition, either from a fuel economy standpoint or power demand standpoint. In other words, the phase adjuster 100 is configured to change or modify a phase of the eccentric shaft 180 relative to the crankshaft 190. FIG. 4 is a schematic drawing and the exact positioning of components relative to each other can vary.

The phase adjuster 100 is operatively connected to both the crankshaft 190 and the eccentric shaft 180. This connection or interface between the phase adjuster 100 and the crankshaft 190 and eccentric shaft 180 can be achieved in a variety of ways. Additionally, the phase adjuster 100 can be arranged between different driving components and driven components besides a crankshaft and an eccentric shaft.

In one aspect, the phase adjuster 100 has a gear train configured to operatively connect the crankshaft 190 to the eccentric shaft 180. The gear train can comprise gears 1, 14, 180*a*, 190*a* which are shown in FIG. 4 for illustrative purposes. The ratio and sizing of the gears 1, 14, 180*a*, 190*a* can vary. Other driving engagements can be provided.

In one embodiment, the gears 1, 14, 180*a*, 190*a* drive the eccentric shaft 180 at half the speed of the crankshaft 190. The eccentric shaft 180 can be driven in continuous rotation at half of the crankshaft speed, in one embodiment. As described in more detail herein, hydraulic fluid or oil can be used along with mechanical springs or biasing elements to control the compression ratio.

In some configurations, a connecting plate can be arranged on the crankshaft 190. In one aspect, the connecting plate is non-rotatably connected, i.e. rotationally fixed, to the crankshaft 190. Connecting rods can also connect the eccentric shaft 180 to the crankshaft 190, and connect an engine piston to the connecting plate.

One skilled in the art would understand that aspects of these components can be omitted, modified, supplemented or otherwise changed, based on the present disclosure.

FIG. 1 illustrates a cross-sectional view of an example embodiment of the phase adjuster 100 for the cranktrain 200. Power enters the phase adjuster 100 through an input gear 1 from a primary mover. As used herein, the term primary mover refers to any driving component, such as the crankshaft 190, an electric motor, or other driving input component. The input gear 1 can be configured to engage or mesh with a gear 190*a* mounted on or fixed to the crankshaft 190.

The input gear 1 is connected to a drive plate 2, which is also referred to as a roller drive plate herein. The term roller drive plate can be used to specifically refer to an embodiment which uses rollers and ramps, as described in more detail herein. However, in another aspect, the drive plate 2 does not interface or otherwise interact with rollers.

As shown in FIG. 1, this connection between the input gear 1 and the roller drive plate 2 can be achieved via at least one rivet or fastener 1*a*. As used herein, the term rivet can be used to refer to any type of fastener.

In one aspect, the roller drive plate 2 is a stamped component. As shown in FIG. 1, the at least one rivet 1*a* is also connected to a support plate 18. As shown in FIG. 1, an inner portion of the input gear 1 is arranged directly between the support plate 18 and the roller drive plate 2. One skilled in the art would understand that this connection arrangement can vary.

The roller drive plate 2 comprises a first plurality of pockets 3 that are dimensioned to capture and support a first plurality of rollers 4. In one aspect, the pockets 3 are formed as spiral pockets 3. The term spiral as used in this respect also means helical, curved, or having ends that are offset or angled relative to each other. In other words, ends of the pockets 3 are displaced from each other in an axial direction and the pockets 3 are angled or curved. In one aspect, the rollers 4 are formed as cylindrical rollers. Other types of rolling elements may be used.

The rollers 4 are configured to be secured or supported between the roller drive plate 2 on a radially outer side, and a piston plate assembly on a radially inner side. In one aspect, the piston plate assembly includes a first piston plate 6 and a second piston plate 7. As shown in FIG. 1, the piston plates 6, 7 are formed as stamped components and are configured to be connected or joined to each other via at least one fastener or rivet 5. The combination of the rollers 4 and the associated pockets, as well as the associated engagement elements, such as the roller drive plate 2, is collectively referred to herein as a first roller-ramp assembly A1.

Radially inward from the pockets 3, the piston plate assembly 6, 7, forms another set of pockets 50 which are also configured to support or capture a second set of rollers 13 along with a hub 11. The pockets 50 are also defined as spiral pockets, in one aspect. The combination of the rollers 13 and the associated pockets 50, as well as the associated engagement elements, such as the hub 11, is collectively referred to herein as a second roller-ramp assembly A2. Additional details of the first and second roller-ramp assemblies A1, A2 are disclosed herein.

Seals, including at least a first seal 8 and a second seal 9, can be provided to prevent fluid communication between axial sides relative to the piston plate assembly 6, 7. In one aspect, a first or radially inner seal 8 is provided on an inner diameter of the piston plate assembly 6, 7, and a second or radially outer seal 9 is provided on an outer diameter of the piston plate assembly 6, 7. More specifically, the radially outer seal 9 is in contact with the second piston plate 7 and the roller drive plate 2 in a radially outer region, and the radially inner seal 8 is in contact with the second piston plate 7 and the hub 11 in a radially inner region.

As shown in FIG. 1, the piston plate assembly 6, 7 can be axially biased with a return spring 10. In one aspect, the return spring 10 is configured to ensure that the phase adjuster 100 starts at a predetermined compression ratio after a vehicle restart. The return spring 10 can be formed as a helical spring, or any other type of biasing element. In one aspect, the return spring 10 is arranged in a piston control chamber 34, and contacts the support plate 18 as well.

The hub 11 includes a second plurality of pockets 12 and rollers 13 supported by or captured in the piston plate assembly 6, 7. The pockets 12 can be formed as spiral pockets, in one aspect. In one aspect, the hub 11 is connected to the output gear 14, and can be formed integrally with the output gear 14. The hub is configured to transmit power out of the system from the input gear 1 based on engagement of the first and second roller-ramp assemblies A1, A2. One of ordinary skill in the art would understand that other types of actuation and engagement configurations can be used. Additionally, a single roller-ramp assembly could also be used. In one aspect, the output gear 14 meshes or engages with a gear 180*a* fixed to the eccentric shaft 180. In another aspect, the output gear 14 is connected to another gear or any other transmission element configured to transmit power.

An output housing 15 is configured to enclose a portion of the phase adjuster 100 and is configured to support the hub 11. As shown in FIG. 1, a first bearing 16 can be provided between the output housing 15 and the hub 11. A first bushing 17 can be provided between the input gear 1 and the hub 11, and more specifically can be provided between the input gear 1 and the support plate 18.

In one aspect, a second bushing 19 is provided on an axial end of the hub 11 opposite from the end of the hub 11 that includes the first bushing 17. One of ordinary skill in the art would understand that fewer or more bushings can be provided between the hub 11 and any other components.

A second bearing 40 can be provided between a radially outer side of the roller drive plate 2 and a radially inner surface of a valve body housing 20. In one aspect, the valve body housing 20 and the output housing 15 are connected to each other via a fastening element or fastener 21. Collectively, the valve body housing 20 and the output housing 15 can define an outer housing or shell of the phase adjuster 100. In one aspect, thrust loads from the gears 1, 14 and rollers 4, 13 react through the closed loop formed through the bearings (such as bearings 16, 40) and housings (such as housings 15, 20), or through the first bushing 17.

A hydraulic system or circuit is provided for the phase adjuster 100. The hydraulic system or circuit includes multiple elements and components described herein. Generally, the hydraulic system provides hydraulic fluid to either a first side (i.e. left side or high compression ratio side) piston control chamber 34 or a second side (i.e. right side or low compression ratio side) piston control chamber 35, as well as an outer chamber 28.

As shown in FIG. 1, the valve body housing 20 encloses a portion of the phase adjuster 100 and contains flow passages 22 for a control hydraulic line 23 that is configured to be directed into the phase adjuster 100. As shown in FIG. 1, the control hydraulic line 23 begins at a radially outer surface of the valve body housing 20. One of ordinary skill in the art would understand that the valve body housing 20 can be directed from any area into the valve body housing 20.

A control valve 24 controls the flow and pressure of the flow passages 22. In one aspect, the control valve 24 is a solenoid valve that is configured to fill a spool piston control chamber 25 partially defined by a spool valve 26. Fluid is configured to exit the spool piston control chamber 25 through a restricted flow path or leakage gap 27. Fluid from this flowpath is directed into the outer chamber 28.

The spool valve 26 is arranged within the output hub 11 in one aspect. The spool valve 26 seals with the output hub 11 with tight clearances 29 arranged between a radially outer surface of the spool valve 26 and a radially inner surface of the output hub 11.

In one aspect, a back plate 30 can be provided on an axially end of the phase adjuster 100. The back plate 30 can be connected to the valve body housing 20 via a fastener 31, which aids in the assembly of the spool valve 26 with the hub 11 and the valve body housing 20. In one aspect, the spool valve 26 is axially biased to one side with a spool spring 32, which is arranged between the spool valve 26 and the back plate 30.

An end of the spool valve 26 has a piston apply pressure port 33 that is configured to supply fluid to either the first side (i.e. left side or high compression ratio side) piston control chamber 34 or the second side (i.e. right side or low compression ratio side) piston control chamber 35. The two chambers 34, 35 are generally separated by the piston plate assembly 6, 7.

In one aspect, a radial inner boundary of at least one of the first piston control chamber 34 or the second piston control chamber 35 is defined by the hub 11 which is connected or formed with the output gear 14. As shown in FIG. 1, the hub 11 can define the radial inner boundary of both of the piston control chamber 34 and the second piston control chamber 35. As shown in FIG. 1, a radial outer boundary and at least one axial outer boundary is defined by the input gear assembly, i.e. the input gear 1, the support plate 18, or the drive plate 2. The piston plates 6, 7, define an axial inner boundary of a respective one of the first piston control chamber 34 and the second piston control chamber 35.

In one aspect, the piston apply pressure port 33 is defined on a first axial side of the phase adjuster assembly and the control hydraulic line 23 is defined on a second, opposite axial side of the phase adjuster assembly. One of skill in the art would understand that the configuration for the piston apply pressure port 33 and the control hydraulic line 23 can vary.

In one aspect, fluid flow is directed into the piston control chambers 34, 35 through a first and second apply port 36, 37 in the hub 11 and drained or released through a first and second release port 38, 39. In one aspect, the ports 36-39 are formed as cross-drilled openings. The relative openings of the apply ports 36, 37 and release ports 38, 39 are controlled by hydraulically moving the spool valve 26 axially left or right via the control valve 24. In one aspect, movement of the spool valve is controlled via pulse-width modulation. In other words, a position of the spool valve 26 is proportional to the current in the control valve 24, which may be a solenoid.

If a specific one of the apply ports 36, 37 is 100% or completely open, then its corresponding release port 38, 39 is 100% or completely closed, and vice versa for both piston control chambers 34, 35. Any axial position in between can also be achieved, such that the amount of fluid provided to the piston control chambers 34, 35 is completely variable. The first and second release port 38, 39 are shown in dashed lines in FIG. 1 for illustrative purposes.

Leakage is permitted out of the piston control chambers 34, 35 through the first and second bushings 17, 19 if fluid pressure is kept to a low enough amount to maintain pressure. Any leakage through the first and second bushings 17, 19 combines with the control flow drainage in the outer chamber 28 and passes through the bearing 16 and the gears 1, 14 to keep these components lubricated before exiting the phase adjuster 100. Control of the fluid flow could also be facilitated or managed by holes or openings arranged in the housings, such as elements 15, 20, for the gears 1, 14.

Figure 2:
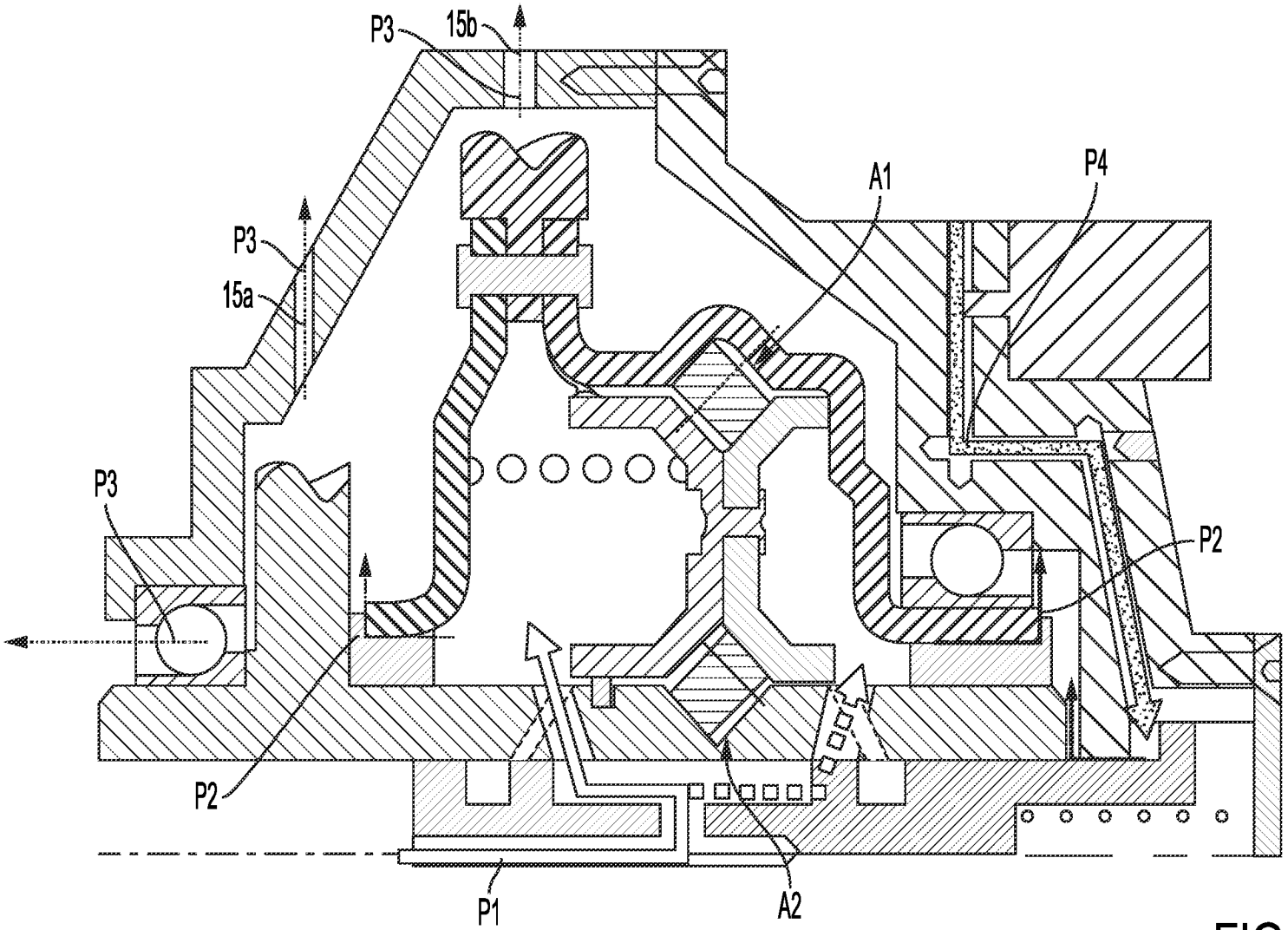
FIG. 2 is a cross-sectional view of the phase adjuster of FIG. 1 showing flow paths for hydraulic fluid according to one aspect.

FIG. 2 illustrates some exemplary flow paths through the phase adjuster 100. As shown in FIG. 2, a first flowpath P1 is provided through the piston apply pressure port 33. This first flowpath P1 is directed to the piston control chambers 34, 35 in a specific manner depending on the arrangement of the spool valve 26. As shown in FIG. 2, the first apply port 36 is opened while the second apply port 37 is closed. Dashed lines are shown in FIG. 2 for illustrative purposes only to show a blocked flowpath associated with P1 to the second apply port 37.

From the piston control chambers 34, 35, second flowpaths P2 are provided as leakage flowpaths that are directed out of the piston control chambers 34, 35 via a respective one of the bushings 17, 19. Once the fluid is directed into the outer chamber 28, a third flowpath P3 is provided that is directed out of the outer chamber 28 and out of the phase adjuster 100. These third flowpaths P3 can be defined through first bearing 16, or via additional drainage holes or openings in other components, such as the housing 15. The drainage holes are illustrated as openings 15*a*, 15*b* in FIG. 2. A fourth flowpath P4 or control flowpath is also shown in FIG. 2. This flowpath P4 generally directs fluid into the flow passages 22, and is ultimately used to control the spool valve 26.

While exemplary flowpaths are illustrated in FIG. 2, one of ordinary skill in the art would understand that the flowpaths can vary. Generally, hydraulic fluid is provided to the assembly in order to selectively pressurize one of the piston control chambers 34, 35. The fluid is also used to lubricate components of the assembly.

During engine or vehicle startup, there is no pressure through the phase adjuster 100, therefore, the return spring 10 holds the piston plate assembly 6, 7 in a maximum compression ratio position until the first piston plate 6 abuts with the roller drive plate 2. While in this position, the spool spring 32 keeps the spool valve 26 in an axially leftmost position.

Once engine oil pressure is established, the left-side piston area 34 is charged or filled with hydraulic pressure, thus keeping the piston plate assembly 6, 7 in the maximum compression ratio position initially. After startup, the position of the piston plate assembly 6, 7 can be adjusted by changing the pressure in the spool piston control chamber 25 with the control valve 24. This moves the spool valve 26 back and forth in an axial direction, thus opening and closing the first and second apply ports 36, 37 and the first and second release ports 38, 39 variably and proportionally.

Pressure differential is then established between left side and right side piston control chambers 34, 35, and the piston plate assembly 6, 7 starts to travel axially if the differential is not zero. When the piston plate assembly 6, 7 moves in an axial direction, the pressure force acts on the spiral ramps through the rollers 4, 13. This creates a tangential force which also rotates the piston plate assembly 6, 7 and therefore rotates the hub 11 relative to the roller drive plate 2, thus achieving the phase adjustment of the output gear 14 relative to the input gear 1. One of ordinary skill in the art would recognize that the hydraulic pressure is used to bias motion in one direction or another, but it is not the primary phasing force in the system. Instead, the crankshaft torsionals are the primary phasing force, and are balanced against the spring force at a given axial position.

In one aspect, the phase adjuster 100 disclosed herein provides the ability to adjust the compression ratio based on a hydraulic assist mode or function. In one aspect, the hydraulic assist mode or function is implemented via the roller-ramp assemblies A1, A2. One skilled in the art would understand that other configurations could be used that do not require rollers and ramps.

The phase adjuster 100 disclosed herein can be adapted to be used in any type of cranktrain or any configuration including a driving and driven element. For example, the phase adjuster 100 can be implemented or realized in a configuration in which an eccentric shaft is driven directly by a crankshaft. In another example, the phase adjuster 100 can be adapted to be used in a configuration in which an eccentric shaft is driven by a separate electric motor and is not directly connected to the crankshaft.

Figure 3A:
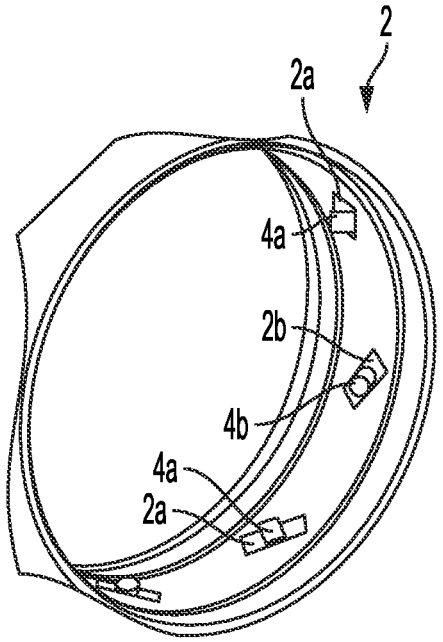
FIGS. 3A and 3B illustrate perspective views of roller-ramp assemblies according to one aspect.
Figure 3B:
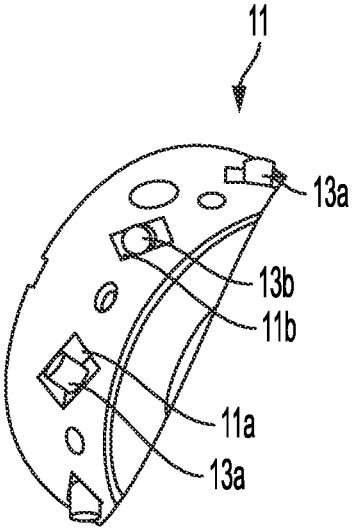

FIGS. 3A and 3B illustrate additional aspects of roller-ramp assemblies A1, A2, and more specifically illustrates specific details of the rollers 4, 13 relative to the roller drive plate 2 and the hub 11. As shown in FIG. 3A, the roller drive plate 2 defines spiral pockets 2*a*, 2*b*. As shown in FIG. 3B, the hub 11 also defines spiral pockets 11*a*, 11*b*. In one aspect, movement of the roller drive plate 2 in a first axial direction associated with a first set of rollers 4*a* and a first set of spiral pockets 2*a* causes rotation of the hub 11 in a first rotational direction via a first set of rollers 13*a* engaged a first set of spiral pockets 11*a*. Similarly, movement of the roller drive plate 2 in a second axial direction associated with a second set of rollers 4*b* and a second set of spiral pockets 2*b* causes rotation of the hub 11 in a second rotational direction via a second set of rollers 13*b* engaged with a second set of spiral pockets 11*b*. In other words, a first group of rollers 4*a*, 13*a* and spiral pockets 2*a*, 11*a* facilitate movement of the piston plate assembly 6, 7, in a first axial direction which yields rotation of the hub 11 in a first rotational direction causing the output gear 14 to be phased relative to the input gear 1 in the first rotational direction. A second group of rollers 4*b*, 13*b* and spiral pockets 2*b*, 11*b* facilitate movement of the piston plate assembly 6, 7 in a second axial direction which yields rotation of the hub 11 in a second rotational direction causing the output gear 14 to be phased relative to the input gear 1 in the second rotational direction.

Torque transmitted through the rollers 4, 4*a*, 4*b*, 13, 13*a*, 13*b* creates an axial force due to the ramp geometry, which acts against the fluid pressure in the piston control chambers 34, 35. The pressure may need to be adjusted to compensate for the input torque and keep the phase angle at the desired or predetermined value. The pressure is controlled to either allow flow into or out of the chambers 34, 35, depending on whether movement of the piston is desired or not.

Although the roller-ramp assemblies A1, A2 are illustrated with specific features in the drawings, one of ordinary skill in the art would understand that the exact configuration of these assemblies can vary. Generally, the phase adjuster 100 provides a configuration in which the piston plate assembly 6, 7 is driven in an axial direction via a hydraulic fluid circuit or system (i.e. at least elements 20, 22, 23, 25, 26, 27, etc.) to phase or adjust a position of the output gear 14 relative to the input gear 1 to transmit power out of the phase adjuster 100.

A method for adjusting the phase between a driving component 190 and a driven component 180 is also disclosed herein. The method includes engaging an input gear 1 with the driving component 190 and engaging an output gear 14 with the driven component 180. The method includes arranging a piston plate assembly 6, 7 operatively between the input gear 1 and the output gear 14 such that axial displacement of the piston plate assembly 6, 7 adjusts a phase between the driving component 190 and the driven component 180. The method includes connecting a hydraulic fluid system to control a first piston control chamber 34 on a first axial side of the piston plate assembly 6, 7, and a second piston control chamber 35 on a second axial side of the piston plate assembly 6, 7. The method includes selectively supplying or releasing hydraulic fluid pressure to at least one of the first piston control chamber 34 or the second piston control chamber 35 such that the piston plate assembly 6, 7 is displaced to adjust the phase between the driving component 190 and the driven component 180. Additional method steps can be included that implement other functional aspects or configurations described herein.

In one aspect, a phase adjuster assembly 100 is provided that includes an input gear 1 configured to be driven by the driving component and an output gear 14. A phase adjuster is connected to the input gear 1 and the output gear 14, and is configured to be hydraulically actuated to adjust a phase between the driving component and the driven component. The phase adjuster can include a piston plate assembly and a hydraulic fluid system or circuit. The input gear 1, the output gear 14, and the phase adjuster are arranged inside a common housing. As shown in FIG. 1, the common housing can be formed from a plurality of plates, such as the output housing 15 and the valve body housing 20.

The phase adjuster disclosed herein is completely variable. In other words, the phase adjuster is configured to adjust the phase between the driven element and the driving element according to multiple compression ratios. In one aspect, axial movement of at least one component of a piston plate assembly, along with oscillating crankshaft torque, facilitate phasing between the input gear and the output gear in incremental and variable steps.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated.

While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

Having thus described the present embodiments in detail, it is to be appreciated and will be apparent to those skilled in the art that many physical changes, only a few of which are exemplified in the detailed description of the disclosure, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the disclosure being indicated by the appended claims rather than by the foregoing description, and all alternate embodiments and changes to this embodiment which come within the meaning and range of equivalency of said claims are therefore to be embraced therein.

LOG OF REFERENCE NUMERALS input gear 1
fastener 1*a*
roller drive plate 2
pockets 2*a*, 2*b*
pockets 3
rollers 4
rollers 4*a*, 4*b*
fastener 5
first piston plate 6
second piston plate 7
first seal 8
second seal 9
return spring 10
hub 11
pockets 11*a*, 11*b*
pockets 12
rollers 13
rollers 13*a*, 13*b*
output gear 14
output housing 15
openings 15*a*, 15*b*
first bearing 16
first bushing 17
support plate 18
second bushing 19
valve body housing 20
fastening element 21
flow passages 22
control hydraulic line 23
control valve 24
spool piston control chamber 25
spool valve 26
clearance 27
outer chamber 28
clearance 29
back plate 30
fastener 31
spool spring 32
piston apply pressure port 33
piston control chambers 34, 35
apply ports 36, 37
release ports 38, 39
second bearing 40
pockets 50
phase adjuster 100
eccentric shaft 180
gear 180*a*
crankshaft 190
gear 190*a*
cranktrain 200

What is claimed is:

1. A phase adjuster assembly for adjusting a phase between a driving component and driven component of an internal combustion engine, the phase adjuster assembly comprising:

an input gear configured to be driven by the driving component;

an output gear configured to drive the driven component and connected to a hub;

a piston plate assembly configured to adjust a phase between the driving component and the driven component via axial displacement of the piston plate assembly, the piston plate assembly including a first piston control chamber on a first side of the piston plate assembly, and a second piston control chamber on a second side of the piston plate assembly, wherein a radial inner boundary of at least one of the first piston control chamber or the second piston control chamber is defined by the hub; and a hydraulic fluid system configured to selectively provide hydraulic fluid to the first piston control chamber and the second piston control chamber to axially displace the piston plate assembly such that the phase between the driving component and the driven component is adjusted.

2. The phase adjuster assembly according to claim 1, wherein the hub defines apply ports and release ports that are selectively fluidly connected to the first piston control chamber and the second piston control chamber.

3. The phase adjuster assembly according to claim 2, wherein the phase adjuster assembly further comprises a spool valve that is axially displaceable to control fluid flow relative to the apply ports and the release ports.

4. The phase adjuster assembly according to claim 3, wherein the spool valve is arranged radially inside of the hub.

5. The phase adjuster assembly according to claim 3, further comprising a spool spring configured to engage the spool valve, and a return spring configured to engage the piston plate assembly.

6. The phase adjuster assembly according to claim 5, wherein the spool spring biases the spool valve in a first axial direction, and the return spring biases the piston plate assembly in a second axial direction opposite from the first axial direction.

7. The phase adjuster assembly according to claim 5, further comprising a spool piston control chamber defined between the spool valve and a valve body housing.

8. The phase adjuster assembly according to claim 7, wherein the valve body housing includes a control hydraulic line and flow passages that are configured to direct fluid into the spool piston control chamber depending on a relative position of a control valve.

9. The phase adjuster assembly according to claim 7, wherein an outer chamber is defined at least partially between an output housing and a valve body housing in an outer direction, and a drive plate and a support plate in an inner direction, and the outer chamber is configured to receive fluid via a restricted flowpath from the spool piston control chamber.

10. The phase adjuster assembly according to claim 6, wherein the return spring has a first end engaging the piston plate assembly and a second end engaging a support plate.

11. The phase adjuster assembly according to claim 10, wherein the support plate includes a first end supported on a bushing mounted on the hub, and a second end of the support plate is connected to the input gear.

12. The phase adjuster assembly according to claim 1, wherein the input gear is connected to a support plate and a drive plate, and the drive plate defines roller pockets for a roller-ramp assembly.

13. The phase adjuster assembly according to claim 12, wherein the drive plate defines an interior boundary for an outer fluid chamber, and the drive plate defines an exterior boundary for at least one piston control chamber.

14. The phase adjuster assembly according to claim 1, wherein the driving component is a crankshaft and the driven component is an eccentric shaft.

15. A phase adjuster assembly for adjusting a phase between a driving component and driven component of an internal combustion engine, the phase adjuster assembly comprising:

an input gear configured to be driven by the driving component;

an output gear configured to drive the driven component;

a phase adjuster connected to the input gear and the output gear, the phase adjuster being configured to be hydraulically actuated to adjust a phase between the driving component and the driven component, wherein the phase adjuster includes at least one roller-ramp assembly.

16. A phase adjuster assembly for adjusting a phase between a driving component and driven component of an internal combustion engine, the phase adjuster assembly comprising:

an input gear configured to be driven by the driving component;

an output gear configured to drive the driven component; and a phase adjuster connected to the input gear and the output gear, the phase adjuster being configured to be hydraulically actuated to adjust a phase between the driving component and the driven component, wherein the input gear, the output gear, and the phase adjuster are arranged inside a common housing.

17. The phase adjuster assembly according to claim 16, wherein the phase adjuster includes a piston plate assembly and a hydraulic fluid system, and the phase adjuster adjusts the phase between the driving component and the driven component via application of hydraulic fluid to at least one of a first piston control chamber or a second piston control chamber.

18. The phase adjuster assembly according to claim 17, wherein the piston plate assembly includes at least one piston plate that is configured to be axially displaced to adjust the phase between the driving component and the driven component.

19. The phase adjuster assembly according to claim 16, wherein the output gear is connected to a hub, the input gear is connected to a support plate, and a bushing is arranged between the support plate and the hub.

20. The phase adjuster assembly according to claim 16, wherein the phase adjuster is configured to variably adjust the phase between the driving component and the driven component.

* * * * *